US010431167B2

(12) United States Patent
Liu et al.

(10) Patent No.: US 10,431,167 B2
(45) Date of Patent: Oct. 1, 2019

(54) ELECTRONIC PAPER DISPLAY APPARATUS, SIGNAL TRANSMISSION SYSTEM AND METHOD THEREOF

(71) Applicant: E Ink Holdings Inc., Hsinchu (TW)

(72) Inventors: Chuen-Jen Liu, Taoyuan (TW); Li-Wei Chou, Taoyuan (TW); Jia-Hong Xu, Taoyuan (TW); Yu-Ming Lee, Taoyuan (TW); Chih-Jen Wu, Taoyuan (TW); Chi-Mao Hung, Taoyuan (TW)

(73) Assignee: E Ink Holdings Inc., Hsinchu (TW)

( * ) Notice: Subject to any disclaimer, the term of this patent is extended or adjusted under 35 U.S.C. 154(b) by 206 days.

(21) Appl. No.: 14/857,831

(22) Filed: Sep. 18, 2015

(65) Prior Publication Data

US 2017/0025071 A1 Jan. 26, 2017

(30) Foreign Application Priority Data

Jul. 23, 2015 (TW) ..... 104123815 A

(51) Int. Cl.
*G09G 3/34* (2006.01)

(52) U.S. Cl.
CPC ..... *G09G 3/344* (2013.01); *G09G 2340/12* (2013.01); *G09G 2358/00* (2013.01)

(58) Field of Classification Search
CPC . G09G 3/344; G09G 2340/12; G09G 2358/00
See application file for complete search history.

(56) References Cited

U.S. PATENT DOCUMENTS 6,864,860 B1 * 3/2005 Zien ..... G06F 3/1454 345/1.2
7,190,336 B2 * 3/2007 Fujisawa ..... G06F 1/1613 345/81
7,804,483 B2 9/2010 Zhou et al.
(Continued)

FOREIGN PATENT DOCUMENTS

CN 1279460 1/2001
CN 102523460 6/2012
(Continued)

OTHER PUBLICATIONS

"Office Action of Taiwan Counterpart Application", dated Jul. 6, 2016, p. 1-p. 10, in which the listed references were cited.
(Continued)

*Primary Examiner* — Andrew Sasinowski
(74) *Attorney, Agent, or Firm* — JCIPRNET

(57) ABSTRACT

An electronic paper display apparatus, a signal transmission system and a method thereof are provided. The electronic paper display apparatus is configured to transmit an encrypted signal. The electronic paper display apparatus includes an electronic paper display panel and a display driver. The electronic paper display panel is configured to display a first image or a second image. The display driver is electrically coupled to the electronic paper display panel and configured to output a driving signal to the electronic paper display panel. The display driver drives the electronic paper display panel to alternately display the first image and the second image for transmitting the encrypted signal by using the driving signal during a signal transmission period.

15 Claims, 5 Drawing Sheets

(56) References Cited

U.S. PATENT DOCUMENTS

| | | | | |
|---|---|---|---|---|
| 7,872,633 | B2 | 1/2011 | Zhou et al. | |
| 8,531,389 | B2 | 9/2013 | Johnson et al. | |
| 8,593,396 | B2 | 11/2013 | Amundson et al. | |
| 2007/0080940 | A1* | 4/2007 | Aoki | G06F 3/0308 345/158 |
| 2009/0249077 | A1* | 10/2009 | Gargaro | G06Q 20/382 713/183 |
| 2011/0080530 | A1 | 4/2011 | Koo | |
| 2012/0169605 | A1* | 7/2012 | Lin | G06F 3/023 345/168 |
| 2013/0092740 | A1* | 4/2013 | Lee | G06K 19/07767 235/492 |
| 2013/0337745 | A1 | 12/2013 | Lee | |
| 2014/0071183 | A1* | 3/2014 | Murayama | G09G 3/344 345/690 |
| 2014/0191036 | A1 | 7/2014 | Manion | |
| 2014/0359308 | A1* | 12/2014 | Tsai | H04L 9/14 713/189 |
| 2015/0123887 | A1* | 5/2015 | Shadle | G06F 3/14 345/102 |

FOREIGN PATENT DOCUMENTS

| | | |
|---|---|---|
| CN | 104506543 | 4/2015 |
| TW | 201416907 | 5/2014 |
| WO | 2015098108 | 7/2015 |

OTHER PUBLICATIONS

"Office Action of China Counterpart Application," dated Oct. 9, 2018, pp. 1-10.

* cited by examiner

ELECTRONIC PAPER DISPLAY APPARATUS, SIGNAL TRANSMISSION SYSTEM AND METHOD THEREOF

CROSS-REFERENCE TO RELATED APPLICATION

This application claims the priority benefit of Taiwan application serial no. 104123815, filed on Jul. 23, 2015. The entirety of the above-mentioned patent application is hereby incorporated by reference herein and made a part of this specification.

BACKGROUND OF THE INVENTION

Field of the Invention

The invention relates to a signal transmission method, and particularly relates to a signal transmission system transmitting an encrypted signal by using an electronic paper display apparatus and a method thereof.

Description of Related Art

Electronic paper display apparatus is a new type of display apparatus, which has features of high color contrast, high resolution, small power consumption, low manufacturing cost, etc. In recent years, since display apparatuses are gradually developed towards a trend of light and slim, the electronic paper display apparatus becomes a display apparatus meeting the needs of the public. Since the electronic paper display apparatus has the advantages of light, slim, durable in use and low power consumption in line with energy saving and environmental protection, etc., the electronic paper display apparatus has been widely applied in electronic readers (for example, electronic books, electronic newspapers) or other electronic components (for example, electronic tags). In the application field of the electronic tag, one of the most commonly used recognition techniques is a radio frequency identification (RFID) technique.

By combining the RFID technique with an integrated circuit (IC) chip, a read device or a read-write device may be used to read information of the IC chip through a wireless manner. However, regarding some IC chips required to be kept confidential, confidential information stored therein are probably analyzed and duplicated without permission.

Therefore, in case that the electronic paper display apparatus is adopted to serve as the electronic tag, it is important to design an electronic paper display apparatus capable of transmitting an encrypted signal in a more secure manner.

SUMMARY OF THE INVENTION

The invention is directed to an electronic paper display apparatus, a signal transmission system and a method thereof. The electronic paper display apparatus and the system thereof transmit an encrypted signal by alternately displaying different images.

An embodiment of the invention provides an electronic paper display apparatus, configured to transmit an encrypted signal. The electronic paper display apparatus includes an electronic paper display panel and a display driver. The electronic paper display panel is configured to display a first image or a second image. The display driver is electrically coupled to the electronic paper display panel and configured to output a driving signal to the electronic paper display panel. The display driver drives the electronic paper display panel to alternately display the first image and the second image to transmit the encrypted signal by using the driving signal during a signal transmission period.

In an embodiment of the invention, the encrypted signal includes a combination of the first image and the second image displayed during the signal transmission period.

In an embodiment of the invention, the driving signal includes a first signal level and a second signal level. The display driver drives the electronic paper display panel to display the first image by using the driving signal of the first signal level. The display driver drives the electronic paper display panel to display the second image by using the driving signal of the second signal level.

In an embodiment of the invention, the display driver drives the electronic paper display panel by using the driving signal of a first frequency, such that the electronic paper display panel transmits an encoded signal in the encrypted signal. The display driver drives the electronic paper display panel by using the driving signal of a second frequency, such that the electronic paper display panel transmits another encoded signal in the encrypted signal. The first frequency is not equal to the second frequency.

In an embodiment of the invention, the display driver drives the electronic paper display panel by using the driving signal of a plurality of different frequencies, such that the electronic paper display panel transmits one of a plurality of encoded signals in the encrypted signal. The encoded signals transmitted by the electronic paper display panel are determined according to combinations of the different frequencies.

In an embodiment of the invention, the electronic paper display panel further includes a plurality of display regions. The display driver drives each of the display regions of the electronic paper display panel to alternately display the first image and the second image by using the driving signal, such that the electronic paper display panel transmits one of a plurality of encoded signals in the encrypted signal. The encoded signals transmitted by the electronic paper display panel are determined according to combinations of the first image and the second image displayed by the display regions.

An embodiment of the invention provides a signal transmission system, which is configured to transmit an encrypted signal. The signal transmission system includes an electronic paper display apparatus and an image sensing apparatus. The electronic paper display apparatus is configured to alternately display a first image and a second image to transmit the encrypted signal during a signal transmission period. The image sensing apparatus is signally connected to the electronic paper display apparatus, and is configured to receive the encrypted signal and decode the encrypted signal to obtain information included in the encrypted signal.

In an embodiment of the invention, the encrypted signal includes a combination of the first image and the second image displayed by the electronic paper display apparatus during the signal transmission period.

In an embodiment of the invention, the electronic paper display apparatus is driven by a driving signal. The driving signal includes a first signal level and a second signal level. The driving signal of the first signal level drives the electronic paper display apparatus to display the first image. The driving signal of the second signal level drives the electronic paper display apparatus to display the second image.

In an embodiment of the invention, the electronic paper display apparatus is driven by a driving signal. The driving signal includes a first frequency and a second frequency. The driving signal of the first frequency drives the electronic paper display apparatus to transmit an encoded signal in the encrypted signal. The driving signal of the second frequency drives the electronic paper display apparatus to transmit another encoded signal in the encrypted signal. The first frequency is not equal to the second frequency.

In an embodiment of the invention, the electronic paper display apparatus is driven by a driving signal of a plurality of different frequencies, so as to transmit one of a plurality of encoded signals in the encrypted signal. The encoded signals transmitted by the electronic paper display panel are determined according to combinations of the different frequencies.

In an embodiment of the invention, the electronic paper display apparatus includes an electronic paper display panel. The electronic paper display panel includes a plurality of display regions. Each of the display regions alternately displays the first image and the second image, such that the electronic paper display apparatus transmits one of a plurality of encoded signals in the encrypted signal. The encoded signals transmitted by the electronic paper display apparatus are determined according to combinations of the first image and the second image displayed by the display regions.

In an embodiment of the invention, the image sensing apparatus includes an image sensor and a data processor. The image sensor is configured to receive the encrypted signal, and output the encrypted signal. The data processor is electrically connected to the image sensor, and is configured to decode the encrypted signal to obtain the information included in the encrypted signal.

In an embodiment of the invention, the image sensor sends a sensing signal to the electronic paper display apparatus, and the electronic paper display apparatus feeds back the sensing signal to the image sensor, such that the image sensor receives the encrypted signal. The electronic paper display apparatus displaying the first image absorbs at least a part of the sensing signal, and the electronic paper display apparatus displaying the second image reflects at least a part of the sensing signal.

An embodiment of the invention provides a signal transmission method adapted to transmit an encrypted signal. The signal transmission method includes following steps. An electronic paper display apparatus is driven, so as to alternately display a first image and a second image to transmit the encrypted signal during a signal transmission period. Then, the encrypted signal is received and decoded to obtain information included in the encrypted signal.

In an embodiment of the invention, the encrypted signal includes a combination of the first image and the second image displayed by the electronic paper display apparatus during the signal transmission period.

In an embodiment of the invention, the step of driving the electronic paper display apparatus to alternately display the first image and the second image during the signal transmission period includes driving the electronic paper display apparatus by using a driving signal. The driving signal includes a first signal level and a second signal level. The driving signal of the first signal level drives the electronic paper display apparatus to display the first image. The driving signal of the second signal level drives the electronic paper display apparatus to display the second image.

In an embodiment of the invention, the step of driving the electronic paper display apparatus to alternately display the first image and the second image during the signal transmission period includes driving the electronic paper display apparatus by using a driving signal. The driving signal includes a first frequency and a second frequency. The driving signal of the first frequency drives the electronic paper display apparatus to transmit an encoded signal in the encrypted signal, and the driving signal of the second frequency drives the electronic paper display apparatus to transmit another encoded signal in the encrypted signal. The first frequency is not equal to the second frequency.

In an embodiment of the invention, the step of driving the electronic paper display apparatus to alternately display the first image and the second image during the signal transmission period includes driving the electronic paper display apparatus by using the driving signal of a plurality of different frequencies, so as to transmit one of a plurality of encoded signals in the encrypted signal. The encoded signals transmitted by the electronic paper display panel are determined according to combinations of the different frequencies.

In an embodiment of the invention, the electronic paper display apparatus includes an electronic paper display panel. The electronic paper display panel includes a plurality of display regions. In the step of driving the electronic paper display apparatus to alternately display the first image and the second image during the signal transmission period, each of the display regions alternately displays the first image and the second image, such that the electronic paper display apparatus transmits one of a plurality of encoded signals in the encrypted signal. The encoded signals transmitted by the electronic paper display apparatus are determined according to combinations of the first image and the second image displayed by the display regions.

In an embodiment of the invention, the step of receiving the encrypted signal, and decoding the encrypted signal to obtain the information included in the encrypted signal includes following steps. A sensing signal is sent to the electronic paper display apparatus, and the sensing signal fed back by the electronic paper display apparatus is received, so as to receive the encrypted signal. The electronic paper display apparatus displaying the first image absorbs at least a part of the sensing signal, and the electronic paper display apparatus displaying the second image reflects at least a part of the sensing signal.

According to the above description, in the embodiment of the invention, the signal transmission system alternately displays different images by using the electronic paper display apparatus, and encrypts the info nation to be transmitted into the alternately displayed images displayed to transmit the encrypted signal, so as to improve security of signal transmission.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
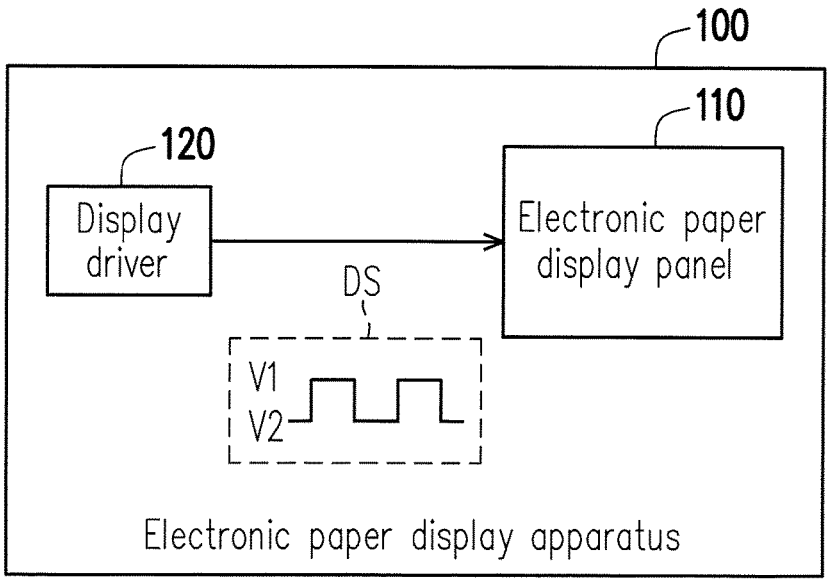
FIG. 1 is a schematic diagram of an electronic paper display apparatus according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic diagram of an electronic paper display apparatus according to an embodiment of the invention. Referring to FIG. 1, in the present embodiment, the electronic paper display apparatus 100 includes an electronic paper display panel 110 and a display driver 120. The electronic paper display panel 110 is driven by the display driver 120, and is configured to display a first image or a second image. In the present embodiment of the invention, in the electronic paper display panel 110, black display particles and white display particles are respectively taken as display media. In the present embodiment, a black image and a white image displayed by the electronic paper display panel 110 are taken as the first image and the second image for description, though the invention is not limited thereto.

In the present embodiment, the display driver 120 is electrically connected to the electronic paper display panel 110, and is configured to output a driving signal DS to the electronic paper display panel 110. In the present embodiment, the display driver 120 may be configured with a signal generator, and the signal generator generates an internal signal to the display driver 120, such that the display driver 120 outputs the driving signal DS to the electronic paper display panel 110. In an embodiment, the display driver 120 may also receive an external signal, and outputs the driving signal DS to the electronic paper display panel 110 according to the received external signal. The method that the display driver 120 generates and outputs the driving signal DS is not limited by the invention. Therefore, in the present embodiment, the display driver 120 drives the electronic paper display panel 110 to alternately display the first image and the second image to transmit an encrypted signal by using the driving signal DS during a signal transmission period.

To be specific, in the present embodiment, the driving signal DS includes a first signal level V1 and a second signal level V2, as shown in FIG. 1, though the invention is not limited thereto. The display driver 120 drives the electronic paper display panel 110 to display the first image by using the driving signal DS of the first signal level V1. Moreover, the display driver 120 drives the electronic paper display panel 110 to display the second image by using the driving signal DS of the second signal level V2.

In detail, in the electronic paper display panel 110 of the present embodiment, since the black display particles and the white display particles are taken as the display media, when the electronic paper display panel 110 is subjected to a negative electric field, it displays a white image, and when the electronic paper display panel 110 is subjected to a positive electric field, it displays a black image. Therefore, the driving signal DS of the present embodiment includes the first signal level V1 and the second signal level V2, where the first signal level V1 is higher than the second signal level V2, though the invention is not limited thereto. In this way, the display driver 120 may drive the electronic paper display panel 110 to display the first image (i.e. the black image) by using the first signal level V1 with the positive electric field, and drive the electronic paper display panel 110 to display the second image (i.e. the white image) by using the second signal level V2 with the negative electric field.

Figure 2A:
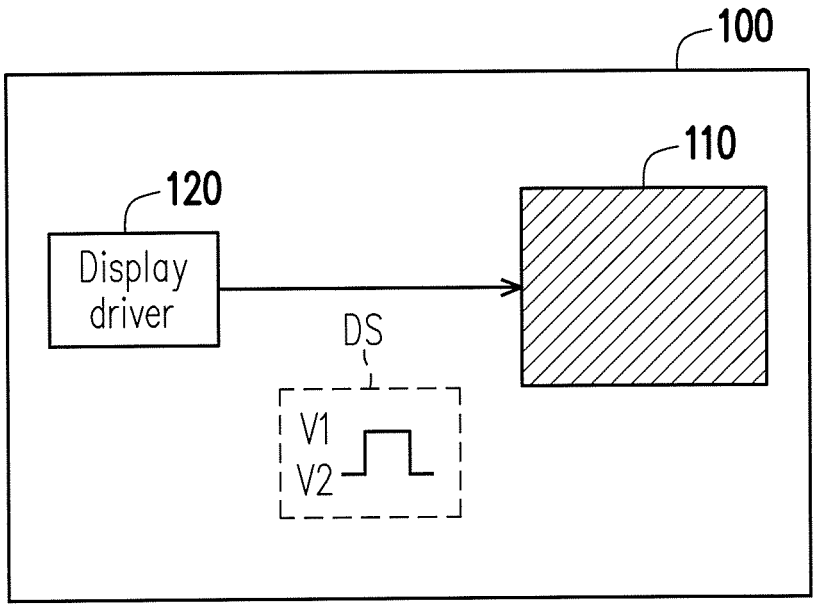
FIG. 2A is a schematic diagram illustrating a situation that an electronic paper display panel is driven by a driving signal to display a first image according to an embodiment of the invention.
Figure 2B:
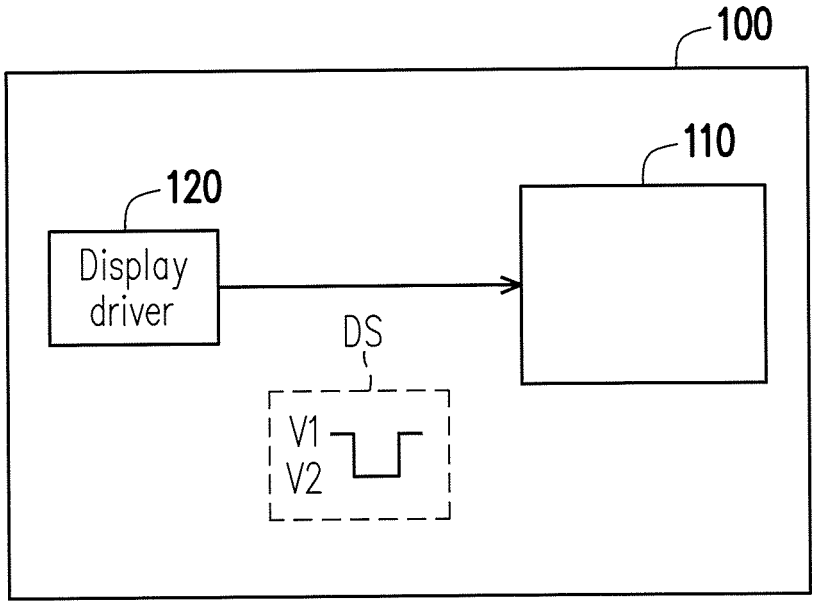
FIG. 2B is a schematic diagram illustrating a situation that an electronic paper display panel is driven by a driving signal to display a second image according to an embodiment of the invention.

In other words, the electronic paper display panel 110 of the present embodiment may be driven by the driving signals of different signal levels to display the corresponding images, and referring to FIG. 2A and FIG. 2B for detailed descriptions thereof, FIG. 2A is a schematic diagram illustrating a situation that the electronic paper display panel 110 is driven by the driving signal DS to display the first image according to an embodiment of the invention, and FIG. 2B is a schematic diagram illustrating a situation that the electronic paper display panel 110 is driven by the driving signal DS to display the second image according to an embodiment of the invention.

Namely, since the electronic paper display panel 110 may be driven by the driving signal DS of different signal levels to display the corresponding images, when the driving signal DS output by the display driver 120 has a signal waveform composed of a series of the first signal levels V1 and the second signal levels V2 (shown as the driving signal DS of FIG. 1), the electronic paper display panel 110 may alternately display the first image and the second image according to the first signal level V1 and the second signal level V2 of the driving signal DS. Therefore, the electronic paper display apparatus 100 may transmit signals based on the characteristic that the electronic paper display panel 110 may be driven by the driving signal DS of different signal levels to display the corresponding images.

It should be noted that since the electronic paper display panel 110 has an image switching speed of a millisecond level, the image switching speed thereof is very fast. Therefore, when the electronic paper display panel 110 transmits a signal by switching different images, such signal is hard to be duplicated and stolen. Besides, the display driver 120 of the present embodiment may further perform an encoding process to the received internal signal or external signal, so as to output the encoded driving signal DS. Therefore, in the present embodiment, the driving signal DS contains an encrypted signal to be transmitted by the electronic paper display panel 110. In this way, during the signal transmission period, and driven by the driving signal DS, a combination of the first image and the second image displayed by the electronic paper display panel 110 includes the encrypted signal, such that the electronic paper display apparatus 100 may transmit the encrypted signal by using the electronic paper display panel 110 to alternately display the first image and the second image, so as to greatly improve security of the signal transmission.

Regarding the aforementioned encoding process, the display driver 120 may define an encoding method thereof according to different requirements, for example, the display driver 120 may encode the internal signal or the received external signal according to a time length, a frequency or a specific encoding rule (for example, according to the rule of the Moss code), so as to encrypt the internal or external signal to generate the driving signal DS containing the encrypted signal, though the invention is not limited to the above encoding method.

In an embodiment, the encoding method adopted by the electronic paper display apparatus 100 is, for example, to define different encoded signals according to a magnitude of the frequency. In the present embodiment, the display driver 120 drives the electronic paper display panel 110 by using the driving signal DS of a first frequency, such that the electronic paper display panel 110 transmits an encoded signal in the encrypted signal. The display driver 120 drives the electronic paper display panel 110 by using the driving signal DS of a second frequency, such that the electronic paper display panel 110 transmits another encoded signal in the encrypted signal. In the present embodiment, the first frequency is not equal to the second frequency.

Figure 3A:
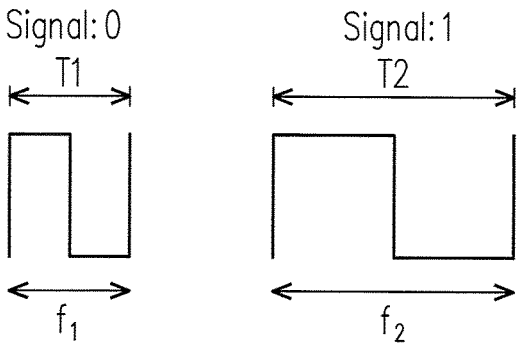
FIG. 3A is a waveform schematic diagram of a driving signal corresponding to an encoded signal according to an embodiment of the invention.

FIG. 3A is a waveform schematic diagram of a driving signal corresponding to the encoded signal according to an embodiment of the invention. Referring to FIG. 3A, for example, in the present embodiment, the display driver 120 drives the electronic paper display panel 110 by using the driving signal DS of different frequencies, so as to encrypt different signals to be transmitted, for example, a signal 0 and a signal 1. In the present embodiment, regarding the driving signal DS of the first frequency $f_1$, the encoded signal thereof, for example, represents the signal 0, and regarding the driving signal DS of the second frequency $f_2$, the encoded signal thereof, for example, represents the signal 1. In the present embodiment, the first frequency $f_1$ is not equal to the second frequency $f_2$. In this way, during a signal transmission period T1, the driving signal DS of the first frequency $f_1$ is switched between the first signal level and the second signal level, and the electronic paper display panel 110 driven by the driving signal DS alternately displays the first image and the second image in the first frequency $f_1$, to as to transmit the signal 0 in the encrypted signal. In the present embodiment, during a signal transmission period T2, the driving signal DS of the second frequency $f_2$ is switched between the first signal level and the second signal level, and the electronic paper display panel 110 driven by the driving signal DS alternately displays the first image and the second image in the second frequency $f_2$, to as to transmit the signal 1 in the encrypted signal. The waveform and the corresponding encoded signal of the driving signal DS shown in FIG. 3A are only an example, and the invention is not limited thereto. In other embodiments, the electronic paper display apparatus 100 may respectively encrypt numbers, English letters or other symbols to be transmitted according to different frequencies, which is not limited by the invention.

In another embodiment of the invention, the display driver 120 drives the electronic paper display panel 110 by using the display signal DS of a plurality of different frequencies, such that the electronic paper display panel 110 transmits one of a plurality of encoded signals in the encrypted signal. In the present exemplary embodiment, the encoded signals transmitted by the electronic paper display panel 110 are determined according to combinations of different frequencies.

Figure 3B:
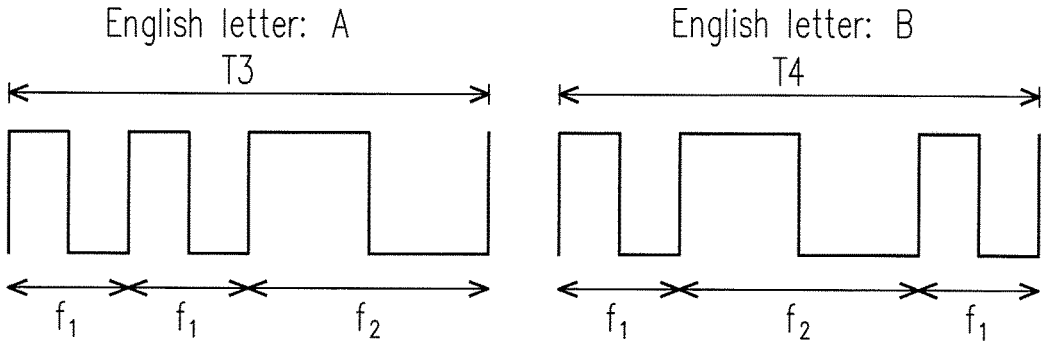
FIG. 3B is a waveform schematic diagram of a driving signal corresponding to an encoded signal according to another embodiment of the invention.

For example, FIG. 3B is a waveform in schematic diagram of a driving signal corresponding to the encoded signal according to another embodiment of the invention. In the present embodiment, the display driver 120 drives the electronic paper display panel 110 by using the driving signal DS having different frequency combinations, so as to encrypt different signals to be transmitted, for example, an English letters A and B. Referring to FIG. 3B, in the present embodiment, during a signal transmission period T3, the frequency of the driving signal DS is changed from the first frequency $f_1$ to the second frequency $f_2$, and the encoded signal formed by a combination thereof, for example, represents the English letter A. During a signal transmission period T4, the frequency of the driving signal DS is changed from the first frequency $f_1$ to the second frequency $f_2$, and is again changed from the second frequency $f_2$ to the first frequency and the encoded signal formed by a combination thereof, for example, represents the English letter B. In the present embodiment, the first frequency $f_1$ is also different to the second frequency $f_2$. Therefore, the electronic paper display panel 110 driven by the driving signal DS may switch the displayed images according to a changing sequence of the first frequency $f_1$ and the second frequency $f_2$, so as to transmit the English letters A and B in the encrypted signal. The waveform and the corresponding encoded signal of the driving signal DS shown in FIG. 3B are only an example, and the invention is not limited thereto. In other embodiments, the electronic paper display apparatus 100 may respectively encrypt numbers, English letters or other symbols to be transmitted according to combinations of more different frequencies, which is not limited by the invention.

In the present embodiment, the electronic paper display apparatus may first encode the internal signal or the received external signal to generate the driving signal containing the encrypted signal. Then, the electronic paper display panel may be driven by the driving signal of different signal levels to display the corresponding images. In this way, the electronic paper display apparatus may alternately display different images to transmit the encrypted signal during the signal transmission period. Therefore, confidentiality and security of the signal transmission are enhanced.

On the other hand, by using the aforementioned electronic paper display apparatus and the signal transmission method thereof, if the transmitted encrypted signal is required to be read out, an image sensing apparatus may be configured to sense the images displayed by the electronic paper display apparatus 100, so as to decode the encrypted signal. In the following embodiment, a structure of a signal transmission system having the electronic paper display apparatus is further illustrated.

Figure 4:
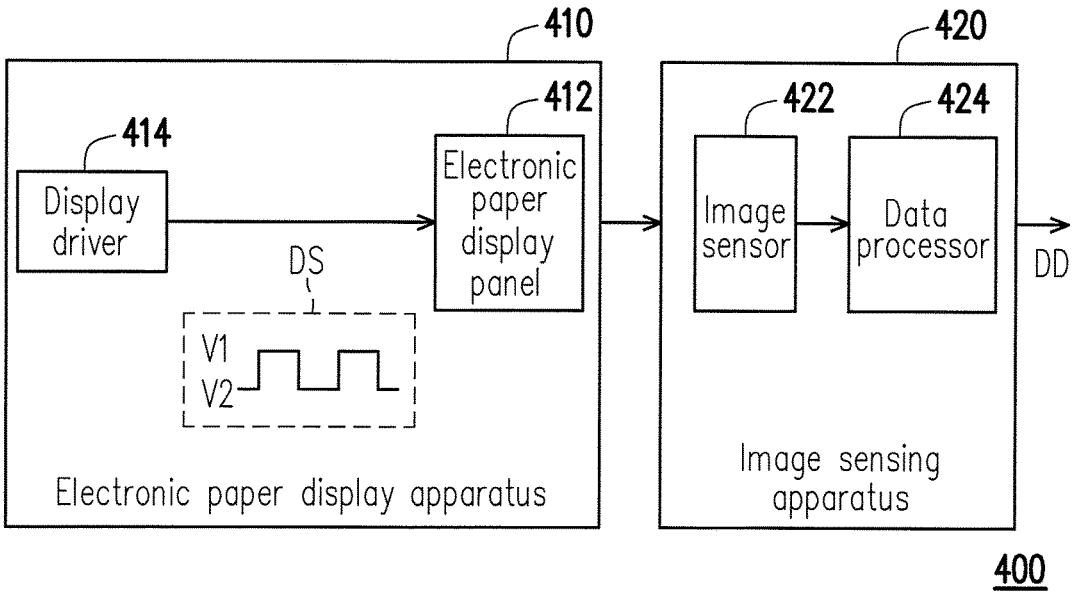
FIG. 4 is a schematic diagram of a signal transmission system according to an embodiment of the invention.

FIG. 4 is a schematic diagram of a signal transmission system according to an embodiment of the invention. Referring to FIG. 4, the signal transmission system 400 of FIG. 4 includes an electronic paper display apparatus 410 and an image sensing apparatus 420. Description of the electronic paper display apparatus 410 and the electronic paper display panel 412, the display driver 414 and the driving signal DS thereof may be deduced by referring to related description of the electronic paper display apparatus 100 of FIG. 1 and the electronic paper display panel 110, the display driver 120 and the driving signal DS thereof, and details thereof are not repeated.

In the present embodiment, the image sensing apparatus 420 is signally connected to the electronic paper display apparatus 410 for receiving the encrypted signal transmitted by the electronic paper display apparatus 410, and decoding the encrypted signal to obtain information included in the encrypted signal. In the present embodiment, the image sensing apparatus 420 includes an image sensor 422 and a data processor 424. The image sensor 422 may be implemented by an infrared sensing device, a charge coupled device (CCD) or a complementary metal oxide semiconductor (CMOS), which is not limited by the invention. The image sensor 422 is configured to receive the encrypted signal transmitted by the electronic paper display apparatus 410, and output the encrypted signal to the post data processor 424.

In the present embodiment, the data processor 424 is electrically connected to the image sensor 422, and is configured to decode the encrypted signal to obtain the information included in the encrypted signal. The data processor 424 is, for example, a central processing unit (CPU), or other programmable general purpose or special purpose microprocessor, a digital signal processor (DSP), a programmable controller, application specific integrated circuits (ASIC), a programmable logic device (PLD) or other similar devices or a combination of these devices, which is not limited by the invention. An embodiment is provided below to describe detailed steps of a signal transmission method below.

Figure 5:
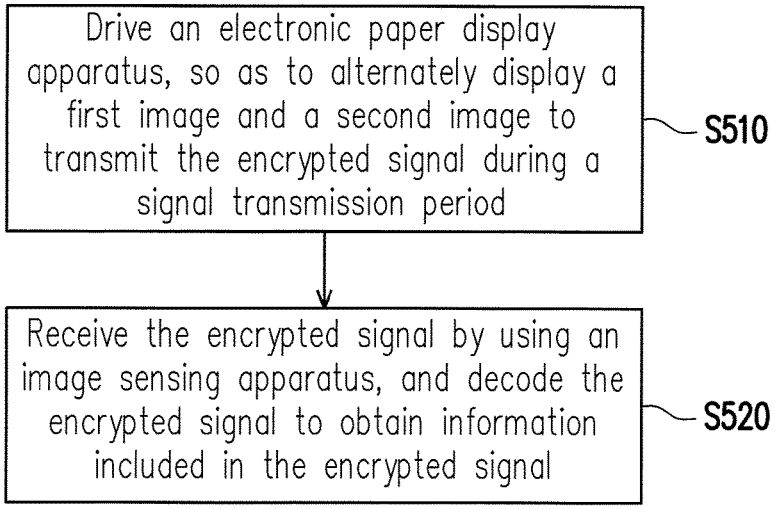
FIG. 5 is a flowchart illustrating a signal transmission method according to an embodiment of the invention.

FIG. 5 is a flowchart illustrating a signal transmission method according to an embodiment of the invention. Referring to FIG. 5, the signal transmission method of the present embodiment is at least adapted to the electronic paper display apparatus 410 and the image sensing apparatus 420 of FIG. 4. Detailed steps of the signal transmission method of the present embodiment are described below with reference of the electronic paper display apparatus 410 and the image sensing apparatus 420.

First, in step S510, at the emitting end, the display driver 414 drives the electronic paper display panel 412 of the electronic paper display apparatus 410 to alternately display the first image and the second image during the signal transmission period, so as to transmit the encrypted signal. In the present embodiment, similar to the embodiment of FIG. 1, the electronic paper display panel 412 also adopts the black display particles and the white display particles to serve as display media, though the invention is not limited thereto. During the signal transmission period, the electronic paper display apparatus 410 may alternately display the first image constructed by, for example, the black display particles and the second image constructed by, for example, the white display particles to transmit the encrypted signal.

In step S520, at the receiving end, the signal transmission system 400 receives and decodes the encrypted signal by using the image sensing apparatus 420, so as to obtain the information included in the encrypted signal. In the present embodiment, the image sensor 422 of the image sensing apparatus 420, for example, sends a sensing signal to the electronic paper display apparatus 410, and the electronic paper display apparatus 410 feeds back the sensing signal to the image sensor 422 to make the image sensor 422 to receive the encrypted signal. It should be noted that the electronic paper display apparatus 410 displaying the first image absorbs at least a part of the sensing signal, and the electronic paper display apparatus 410 displaying the second image reflects at least a part of the sensing signal.

Generally, when the infrared sensing device detects the image displayed by the electronic paper display apparatus, a black part of the image may absorb an infrared ray (the sensing signal) emitted by the infrared sensing device, and a white part of the image may reflect the infrared ray (the sensing signal) emitted by the infrared sensing device. In the present embodiment, the infrared sensing device is, for example, adopted to serve as the image sensor 422, though the invention is not limited thereto. In this case, while the electronic paper display apparatus 410 alternately displays the first image constructed by the black display particles and the second image constructed by the white display particles, the infrared sensing device emits the infrared ray to the electronic paper display apparatus 410 to dynamically detect the encrypted signal transmitted by the electronic paper display apparatus 410. In this way, the electronic paper display apparatus 410 displaying the first image (black image) may absorb at least a part of the infrared ray, and the electronic paper display apparatus 410 displaying the second image (white image) may reflect at least a part of the infrared ray, such that the infrared sensing device may sense the encrypted signal transmitted by the images displayed by the electronic paper display apparatus 410 according to the feedback sensing signal.

Then, after the image sensor 422 receives the encrypted signal, the image sensor 422 transmits the encrypted signal to the data processor 424 for decoding. The data processor 424 may analyze the images of the electronic paper display apparatus 410 according to the encrypted signal transmitted by the image sensor and the corresponding encoding method (for example, the encoded signal with different frequencies or a combination thereof, though the invention is not limited thereto), so as to obtain information DD included in the encrypted signal. It should be noted that the encrypted signal transmitted through the signal transmission system 400 may be further encrypted in advance by using at least one algorithm. The image sensor 422, for example, has a corresponding post-end processing algorithm to decode the encrypted signal, so as to obtain the information DD included in the encrypted signal. In this way, the encrypted signal transmitted by the electronic paper display apparatus 410 is not only hard to be duplicated and stolen, a plurality of security measures may be adopted to enhance security of the signal transmission.

In brief, according to the signal transmission system and the method thereof of the invention, the transmitting end may transmit the encrypted signal through the measure that the electronic paper display apparatus alternately displays the first image and the second image. At the receiving end, an infrared sensing device may be adopted to detect the images alternately displayed by the electronic paper display apparatus, so as to receive the encrypted signal. Then, the data processor is configured to decode the encrypted signal to obtain the information included in the encrypted signal. In this way, not only the encrypted signal transmitted by the electronic paper display apparatus 410 is hard to be duplicated and stolen, a plurality of security measures may be adopted to enhance security of the signal transmission.

Besides, in the other embodiments of the invention, the electronic paper display panels 110 and 412 may also transmit the encrypted signal through a method different to the aforementioned display method. For example, the electronic paper display panel 412 may further include a plurality of display regions, and the display driver 414 drives each of the display regions of the electronic paper display panel 410 to alternately display the first image and the second image by using the driving signal DS, such that the electronic paper display panel transmit one of a plurality of encoded signal in the encrypted signal. The encoded signals transmitted by the electronic paper display panel 410 are, for example, determined according to combinations of the first image and the second image displayed by the display regions. Moreover, since enough instructions and recommendations for the signal transmission method and the panel driving method of the electronic paper display apparatus 410 of the present exemplary embodiment may be learned from the descriptions of the embodiments of FIG. 1 to FIG. 3, detailed description thereof is not repeated.

Figure 6:
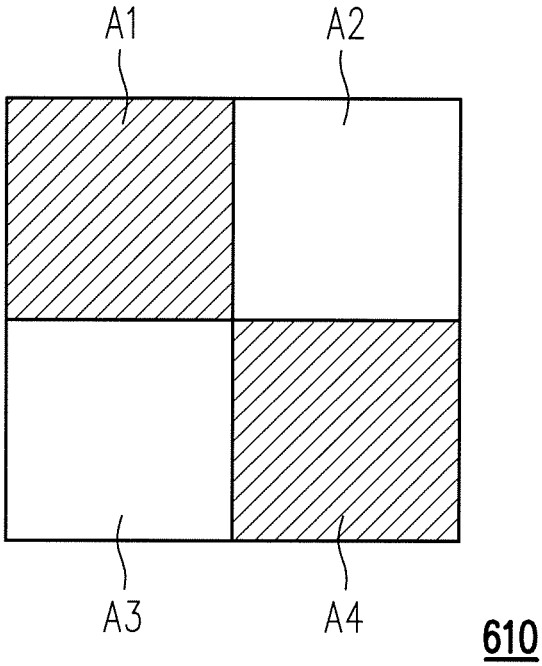
FIG. 6 is a schematic diagram of a plurality of display regions of an electronic paper display panel according to an embodiment of the invention.

To be specific, referring to FIG. 6, FIG. 6 is a schematic diagram of a plurality of display regions of an electronic paper display panel according to an embodiment of the invention. In the present embodiment, the electronic paper display panel 610 includes a plurality of display regions A1, A2, A3 and A4. The electronic paper display panel 610 is driven by the driving signal DS to make each of the display regions A1, A2, A3 and A4 to respectively display the first image and the second image. For example, when the display regions A1 and A4 display the first image, and the display region A2 and A3 display the second image, a combination of the images may correspond to one of a plurality of encoded signals, and the encoded signals may be defined by the user, as shown in FIG. 6, though the invention is not limited thereto. In this way, the electronic paper display panel 610 of the present embodiment may produce more types of the encoded signal through combinations of the first image and the second image displayed by each of the display regions. Not only such encoded signal may be defined by the user, the electronic paper display panel 610 may also quickly switch the images to enhance security and confidentiality to transmit the encrypted signal. Moreover, since enough instructions and recommendations for the electronic paper display panel, the signal transmission method thereof and the panel driving method thereof provided by the exemplary embodiment of the invention may be learned from the descriptions of the embodiments of FIG. 1 to FIG. 5, detailed descriptions thereof are not repeated.

In summary, according to the electronic paper display apparatus, the signal transmission system and the method thereof provided by the embodiments of the invention, the driving signal includes the encoded signal to be transmitted, so as to drive the electronic paper display panel to quickly and alternately display different images to transmit the encrypted signal during the signal transmission period. While the electronic paper display apparatus switches the images, the image sensing apparatus is configured to detect the images alternately displayed by the electronic paper display apparatus to receive and decode the encrypted signal, so as to obtain the information included by the encrypted signal. Moreover, the electronic paper display panel may include a plurality of display regions to generate a plurality of types of the encoded signal. Therefore, the encrypted signal transmitted by the electronic paper display device is hard to be duplicated and stolen, and a plurality of security measures may be adopted to enhance security of the signal transmission.

It will be apparent to those skilled in the art that various modifications and variations may be made to the structure of the invention without departing from the scope or spirit of the invention. In view of the foregoing, it is intended that the invention cover modifications and variations of this invention provided they fall within the scope of the following claims and their equivalents.

What is claimed is:

1. An electronic paper display apparatus, configured to transmit a first encrypted signal, the electronic paper display apparatus comprising:

an electronic paper display panel, configured to display a first image and a second image; and a display driver, electrically coupled to the electronic paper display panel and configured to output a driving signal to the electronic paper display panel, wherein the display driver drives the electronic paper display panel to alternately display the first image and the second image to transmit the first encrypted signal by using the driving signal during a signal transmission period, wherein the first encrypted signal comprises a combination of the first image and the second image displayed during the signal transmission period, wherein the driving signal comprises a first signal level and a second signal level, the display driver drives the electronic paper display panel to display the first image by using the driving signal of the first signal level, and the display driver drives the electronic paper display panel to display the second image by using the driving signal of the second signal level, wherein the driving signal contains a second encrypted signal generated by further encrypting the first encrypted signal.

2. The electronic paper display apparatus as claimed in claim 1, wherein the display driver drives the electronic paper display panel by using the driving signal of a first frequency, such that the electronic paper display panel transmits an encoded signal in the first encrypted signal, and the display driver drives the electronic paper display panel by using the driving signal of a second frequency, such that the electronic paper display panel transmits another encoded signal in the first encrypted signal, wherein the first frequency is not equal to the second frequency.

3. The electronic paper display apparatus as claimed in claim 1, wherein the display driver drives the electronic paper display panel by using the driving signal of a plurality of different frequencies, such that the electronic paper display panel transmits one of a plurality of encoded signals in the first encrypted signal, wherein the encoded signals transmitted by the electronic paper display panel are determined according to combinations of the different frequencies.

4. The electronic paper display apparatus as claimed in claim 1, wherein the electronic paper display panel further comprises a plurality of display regions, the display driver drives each of the display regions of the electronic paper display panel to alternately display the first image and the second image by using the driving signal, such that the electronic paper display panel transmits one of a plurality of encoded signals in the first encrypted signal, wherein the encoded signals transmitted by the electronic paper display panel are determined according to combinations of the first image and the second image displayed by the display regions.

5. A signal transmission system, configured to transmit a first encrypted signal, the signal transmission system comprises:

an electronic paper display apparatus, configured to alternately display a first image and a second image to transmit the first encrypted signal during a signal transmission period; and an image sensing apparatus, signally connected to the electronic paper display apparatus, configured to receive the first encrypted signal and decode the first encrypted signal to obtain information included in the first encrypted signal, wherein the first encrypted signal comprises a combination of the first image and the second image displayed by the electronic paper display apparatus during the signal transmission period, wherein the electronic paper display apparatus is driven by a driving signal, the driving signal comprises a first signal level and a second signal level, the driving signal of the first signal level drives the electronic paper display apparatus to display the first image, and the driving signal of the second signal level drives the electronic paper display apparatus to display the second image, wherein the driving signal contains a second encrypted signal generated by further encrypting the first encrypted signal.

6. The signal transmission system as claimed in claim 5, wherein the driving signal comprises a first frequency and a second frequency, the driving signal of the first frequency drives the electronic paper display apparatus to transmit an encoded signal in the first encrypted signal, and the driving signal of the second frequency drives the electronic paper display apparatus to transmit another encoded signal in the first encrypted signal, wherein the first frequency is not equal to the second frequency.

7. The signal transmission system as claimed in claim 5, wherein the electronic paper display apparatus is driven by the driving signal of a plurality of different frequencies, so as to transmit one of a plurality of encoded signals in the first encrypted signal, wherein the encoded signals transmitted by the electronic paper display panel are determined according to combinations of the different frequencies.

8. The signal transmission system as claimed in claim 5, wherein the electronic paper display apparatus comprises an electronic paper display panel, the electronic paper display panel comprises a plurality of display regions, each of the display regions alternately displays the first image and the second image, such that the electronic paper display apparatus transmits one of a plurality of encoded signals in the first encrypted signal, wherein the encoded signals transmitted by the electronic paper display apparatus are determined according to combinations of the first image and the second image displayed by the display regions.

9. The signal transmission system as claimed in claim 5, wherein the image sensing apparatus comprises:

an image sensor, configured to receive the first encrypted signal, and outputting the first encrypted signal; and a data processor, electrically connected to the image sensor, and configured to decode the first encrypted signal to obtain the information included in the first encrypted signal.

10. The signal transmission system as claimed in claim 9, wherein the image sensor sends a sensing signal to the electronic paper display apparatus, and the electronic paper display apparatus feeds back the sensing signal to the image sensor to enable the image sensor to receive the first encrypted signal, wherein the electronic paper display apparatus displaying the first image absorbs at least a part of the sensing signal, and the electronic paper display apparatus displaying the second image reflects at least a part of the sensing signal.

11. A signal transmission method, adapted to transmit a first encrypted signal, the signal transmission method comprising:

driving an electronic paper display apparatus, so as to alternately display a first image and a second image to transmit the first encrypted signal during a signal transmission period; and receiving the first encrypted signal, and decoding the first encrypted signal to obtain information included in the first encrypted signal, wherein the first encrypted signal comprises a combination of the first image and the second image displayed by the electronic paper display apparatus during the signal transmission period, wherein the step of driving the electronic paper display apparatus to alternately display the first image and the second image during the signal transmission period comprises:

driving the electronic paper display apparatus by using a driving signal, wherein the driving signal comprises a first signal level and a second signal level, the driving signal of the first signal level drives the electronic paper display apparatus to display the first image, and the driving signal of the second signal level drives the electronic paper display apparatus to display the second image, wherein the driving signal contains a second encrypted signal generated by further encrypting the first encrypted signal.

12. The signal transmission method as claimed in claim 11, wherein the driving signal comprises a first frequency and a second frequency, the driving signal of the first frequency drives the electronic paper display apparatus to transmit an encoded signal in the first encrypted signal, and the driving signal of the second frequency drives the electronic paper display apparatus to transmit another encoded signal in the first encrypted signal, wherein the first frequency is not equal to the second frequency.

13. The signal transmission method as claimed in claim 11, wherein the step of driving the electronic paper display apparatus to alternately display the first image and the second image during the signal transmission period comprises:

driving the electronic paper display apparatus by using the driving signal of a plurality of different frequencies, so as to transmit one of a plurality of encoded signals in the first encrypted signal, wherein the encoded signals transmitted by the electronic paper display panel are determined according to combinations of the different frequencies.

14. The signal transmission method as claimed in claim 11, wherein the electronic paper display apparatus comprises an electronic paper display panel, the electronic paper display panel comprises a plurality of display regions, and in the step of driving the electronic paper display apparatus to alternately display the first image and the second image during the signal transmission period, each of the display regions alternately displays the first image and the second image, such that the electronic paper display apparatus transmits one of a plurality of encoded signals in the first encrypted signal, wherein the encoded signals transmitted by the electronic paper display apparatus are determined according to combinations of the first image and the second image displayed by the display regions.

15. The signal transmission method as claimed in claim 11, wherein the step of receiving the first encrypted signal, and decoding the first encrypted signal to obtain the information included in the first encrypted signal comprises:

sending a sensing signal to the electronic paper display apparatus, and receiving the sensing signal fed back by the electronic paper display apparatus, so as to receive the first encrypted signal, wherein the electronic paper display apparatus displaying the first image absorbs at least a part of the sensing signal, and the electronic paper display apparatus displaying the second image reflects at least a part of the sensing signal.

* * * * *